US006220054B1

(12) United States Patent
Rathbone

(10) Patent No.: US 6,220,054 B1
(45) Date of Patent: Apr. 24, 2001

(54) SEPARATION OF AIR

(75) Inventor: Thomas Rathbone, Farnham (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 09/492,486

(22) Filed: Jan. 27, 2000

(30) Foreign Application Priority Data

Jan. 29, 1999 (GB) ..... 9902101

(51) Int. Cl.[7] ..... F25J 1/00
(52) U.S. Cl. ..... 62/644; 62/925
(58) Field of Search ..... 62/644, 925

(56) References Cited

U.S. PATENT DOCUMENTS 4,574,006 * 3/1986 Cheung ..... 62/925
4,805,412 2/1989 Colley .
4,824,453 4/1989 Rottman et al. .
5,067,976 * 11/1991 Agrawal et al. ..... 62/925
5,122,173 * 6/1992 Agrawal et al. ..... 62/644
5,186,007 * 2/1993 Takano et al. ..... 62/656
5,313,802 * 5/1994 Agrawal et al. ..... 62/925
5,425,241 6/1995 Agrawal et al. .

FOREIGN PATENT DOCUMENTS

0446004 A1 4/1991 (EP) .

* cited by examiner

*Primary Examiner*—Ronald Capossela
(74) *Attorney, Agent, or Firm*—Joshua L. Cohen; Salvatore P. Pace

(57) ABSTRACT

Air is separated in a main rectification column comprising a higher pressure column, a lower pressure column and a condenser-reboiler replacing the higher pressure column in heat exchange relationship with the lower pressure column. A first liquid oxygen fraction concentrated in krypton and xenon is formed at the bottom of the lower pressure column and is withdrawn through outlet. Argon-oxygen separation takes place in the column and a vaporous argon-oxygen stream depleted of krypton and xenon is taken from the outlet as it is subjected to further rectification in a column, a second liquid oxygen fraction containing argon impurity being obtained. A stream of the second liquid oxygen fraction is withdrawn from the column through the outlet and is purified in the column so as to obtain a purified oxygen product.

17 Claims, 4 Drawing Sheets

SEPARATION OF AIR

BACKGROUND OF THE INVENTION

This invention relates to a method and plant for separating air. In particular, it relates to the separation of a krypton-xenon concentrate from air.

The main components of air are oxygen and nitrogen. Oxygen and nitrogen are separated from air by rectification at cryogenic temperatures. The air is pre-purified by adsorption to remove impurities such as water vapour and carbon dioxide which freeze at cryogenic temperatures. The purified air is cooled to a temperature suitable for its rectification. The rectification is typically conducted in a double rectification column comprising a higher pressure column, a lower pressure column and a condenser-reboiler placing the higher pressure column in heat exchange relationship with the lower pressure column. The higher pressure column serves to provide liquid nitrogen reflux for the lower pressure column and to produce an oxygen-enriched air fraction which is separated in the lower pressure column. If an argon product is required, a stream of argon-enriched oxygen vapour, typically containing some 5 to 15% by volume of oxygen, is withdrawn from an intermediate region of the lower pressure column and is separated in a further rectification column.

Whereas nitrogen, oxygen and argon make up more than 99% by volume of ambient air, the proportions of krypton and xenon in it are small indeed. Thus, each million volumes of air contains about 1.1 volumes of krypton but only 0.08 volumes of xenon. Nonetheless, krypton and xenon are both valuable industrial products. Both gases are used in lighting in view of their fluorescent properties. In addition, xenon is used in flash photography and X-ray photography. Xenon also has anaesthetic properties and was used in the former Soviet Union as an anaesthetic gas for maintaining a state of anaesthesia.

Because krypton and xenon have a low volatility in comparison to oxygen, they tend to accumulate in the liquid oxygen fraction which is obtained at the bottom of the lower pressure column of the double rectification column during separation of air to form an oxygen product. Nonetheless, the proportion of krypton and xenon in this bottom fraction is still very small and a number of purification steps need to be formed in order to obtain relatively pure krypton and xenon products. The first of these purification steps involves continuously withdrawing a stream of krypton-xenon concentrate from the bottom of the lower pressure column and separating it in a further rectification column which is provided with both a reboiler and a condenser. According to W H Isalski at page 97 of his textbook "*Separation of Gases*" (Clarendon Press, Oxford (1989)) the bottom fraction obtained from the further concentration of the liquid oxygen in krypton and xenon still only contains from 0.1 to 0.2% by volume of krypton and xenon. The bottom fraction is subjected to so-called secondary and tertiary separations in order to provide krypton and xenon products. Frequently, a significant proportion of the krypton/xenon content of the air is lost in gaseous oxygen product. (Even more would be lost were oxygen product to be taken in liquid state).

There is therefore a need to improve upon the conventional method and plant for obtaining the krypton-xenon product by making it possible both to achieve relatively easily a greater proportion of krypton and xenon in the concentrate and to improve the recovery of krypton and xenon. It is the aim of the method and plant according to the invention to meet this need.

SUMMARY OF THE INVENTION

According to the present invention there is provided a method of separating air, comprising subjecting air to a main rectification which includes an argon-oxygen separation and in which a first liquid oxygen fraction concentrated in krypton is formed, taking a vaporous argon-oxygen stream depleted of krypton and xenon from the main rectification, subjecting the vaporous argon-oxygen stream to further rectification and thereby obtaining a second liquid oxygen fraction containing argon impurity, taking a stream of the first liquid oxygen fraction as a krypton-xenon concentrate, and purifying the second liquid oxygen fraction separately from the main rectification and thereby obtaining a purified oxygen product.

The invention also provides plant for separating air, comprising a main rectification column for performing a main rectification of air so as to obtain a first liquid oxygen fraction concentrated in krypton and xenon, the main rectification column having an argon-oxygen separation section; a first outlet from the main rectification column for a vaporous argon-oxygen stream depleted of krypton and xenon; a further rectification column for obtaining from the vaporous argon-oxygen stream a second liquid oxygen fraction containing argon impurity; at least one additional liquid-vapour contact column or column section for purifying the second liquid oxygen fraction separately from the main rectification and for thereby obtaining a purified oxygen product; and a second outlet from the main rectification column for a stream of the first liquid oxygen fraction as a krypton-xenon concentrate.

By forming a purified oxygen product separately from the main rectification it becomes possible in the method and plant according to the present invention to reduce the krypton/xenon losses in the purified oxygen product and obtain a higher recovery of krypton/xenon than would be the case with conventional methods. Indeed, the purified oxygen product has a lower concentration of krypton/xenon than would be possible if the oxygen product were simply taken from the bottom of the lower pressure column of a double rectification column in a conventional manner.

Another advantage of the method and plant according to the invention is their simplicity.

The main rectification is preferably conducted in a double rectification column comprising a higher pressure column, a lower pressure column, and a condenser-reboiler placing the higher pressure column in heat exchange relationship with the lower pressure column. In one alternative, the main rectification may be performed in a single rectification column, for example, as shown in GB-A-1 258 568.

Preferably, no (gaseous) oxygen product is taken from the main rectification apart from any oxygen recovered from the krypton-xenon concentrate. It is, however, within the scope of the invention to take additional oxygen product in vapour state directly from the main rectification. Such a practice entails enhanced losses of krypton and xenon but these losses are not as great as they would be were all the oxygen product to be taken directly from the main rectification.

The further rectification is preferably conducted in one or more further rectification columns so as to give either a crude argon fraction containing oxygen impurity or an oxygen-free argon fraction in addition to the second liquid oxygen fraction.

The purification of the second liquid oxygen fraction preferably comprises countercurrent contact between a stripping gas and a flow of the second liquid oxygen fraction.

Following this countercurrent contact the stripping gas is preferably introduced into the further rectification column or one of the further rectification columns and at least part of the stripped second liquid oxygen fraction taken as product.

The purification of the second liquid oxygen fraction is preferably performed in a stripping column separate from the further rectification column or columns. An alternative arrangement, however, is to perform the purification in a discrete stripping section of the further rectification column or columns. Such an arrangement is often not preferred because it adds to the total height of the further rectification column or columns. Another alternative arrangement is to house the stripping section in the main rectification column, albeit in such a way that the second liquid oxygen fraction is kept separate from the first liquid oxygen fraction. In a typical example of such an arrangement, the stripping section is provided in an annular region of the main rectification column which surrounds the oxygen-argon separation region thereof, or at least a part of such region. Walls are provided so as to separate the two regions from one another. Because a purified oxygen product is obtained from the second liquid oxygen fraction, the fluid traffic in the argon-oxygen separation region of the main rectification column is reduced in comparison with comparable conventional practice. It is thereby often possible to locate the stripping section in the lower pressure column without having to adopt the expedient of providing a step in the outer shell of the lower pressure column so as to provide a wider diameter region thereof in order to accommodate the stripping section.

In some preferred examples of the method and plant according to the invention the stripping gas is formed by reboiling a part of the stripped second liquid oxygen fraction. Preferably such reboiling is performed in a reboiler which is heated by nitrogen separated in the higher pressure column of the double rectification column. Resulting condensed nitrogen is preferably returned to the double rectification column to serve as reflux therein.

In alternative preferred examples of the method and plant according to the invention, the stripping gas is taken from the main rectification column. It is preferably taken from the vapour formed by reboiling a part of the first liquid oxygen fraction. As such, the stripping gas inevitably contains an appreciable quantity of krypton and xenon. If it is wished to avoid loss of such krypton and xenon in the purified oxygen product, the stripping gas is preferably subjected to washing with a first part of the stripped second liquid oxygen fraction, another part or the remainder of the stripped second liquid oxygen fraction being taken as product. The washing is preferably performed in a separate column or in a discrete washing section in the stripping column. Liquid enriched in krypton and xenon is preferably returned to the main rectification from the washing column or washing section.

A stream of the first liquid oxygen fraction is preferably subjected to further concentration (in krypton and xenon) in an auxiliary rectification column. Such further concentration is particularly desirable.

A part of the resulting further concentrated liquid oxygen fraction is preferably reboiled and another part is preferably sent to storage before being subjected to secondary and tertiary treatment stages to yield separate krypton and xenon products. The vapour fraction at the head of the auxiliary rectification column is preferably returned to the main rectification.

The purified oxygen product is preferably taken in liquid state and is raised in pressure and vaporised in heat exchange relationship with air to be separated in the main rectification.

Taking oxygen product in liquid state in conventional methods of obtaining a krypton-xenon concentrate is particularly disadvantageous in view of the large loses of krypton and xenon that result. The invention does not suffer from this disadvantage since the vaporous argon-oxygen mixture is depleted of krypton and xenon.

Refrigeration for the air separation method according to the invention is preferably provided by conventional means, for example by subjecting an elevated pressure air or nitrogen stream to expansion with the performance of external work. One or more turbo-expanders may be used for this purpose.

The air to be separated in the main rectification is preferably purified in a conventional manner.

BRIEF DESCRIPTION OF THE DRAWINGS

The method and plant according to the present invention will now be described by way of example with reference to the accompanying drawings, in which.

Figure 1:
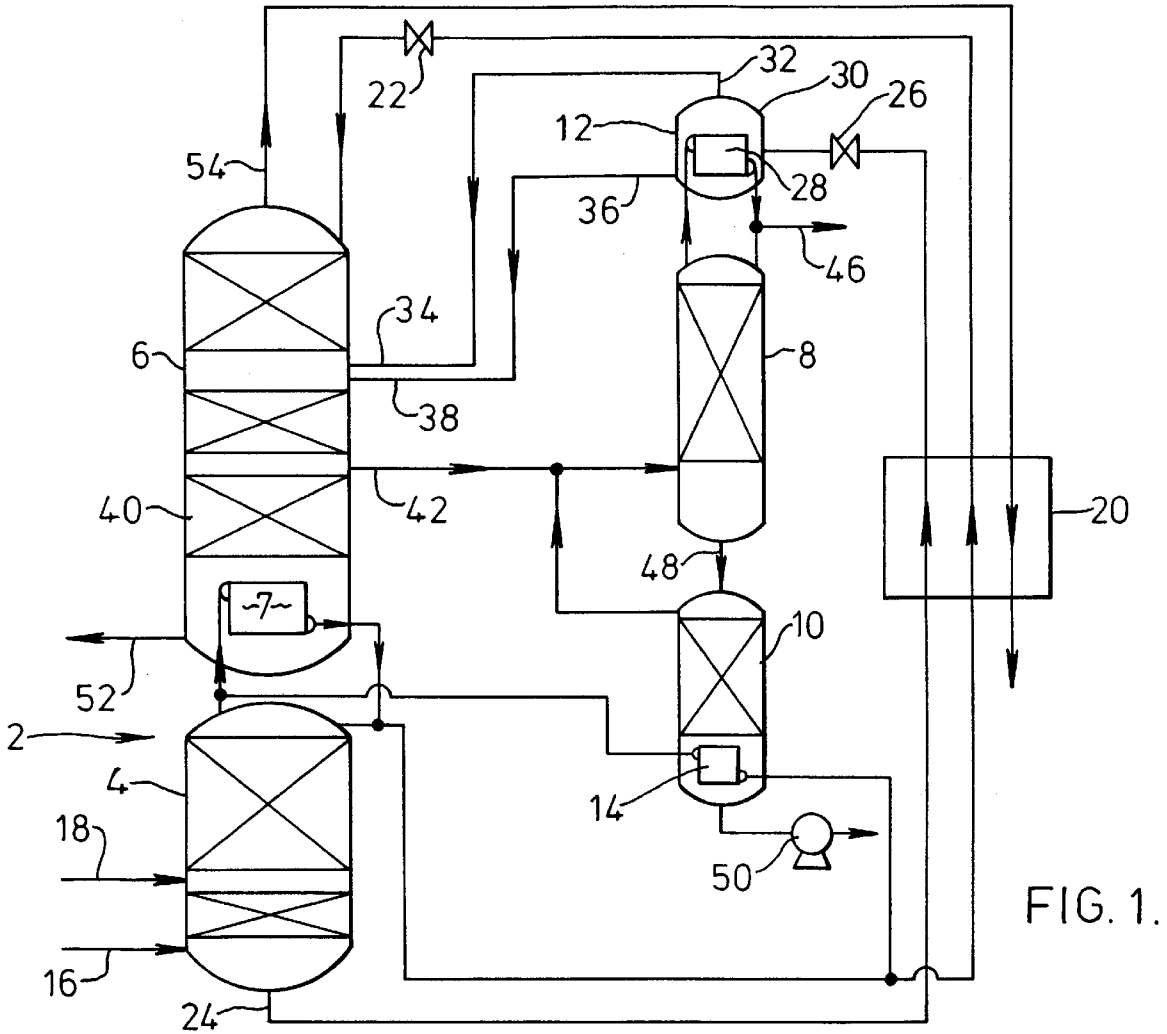
FIG. 1 Is a schematic diagram an arrangement of rectification stripping columns for the separation of argon, oxygen, nitrogen product and a kryptonxenon concentrate from air.

The drawings are not to scale.

Like parts in different figures of the drawings are indicated by the same reference numerals.

DETAILED DESCRIPTION OF THE INVENTION

Referring to FIG. 1 of the drawings, an air separation plant includes an arrangement of liquid-vapour contact columns including a double rectification column 2 comprising a higher pressure column 4, a lower pressure column 6 and a condenser-reboiler 7 placing the top higher pressure column 4 in heat exchange relationship with bottom of the lower pressure column 6; a further rectification column 8, and a stripping column 10. The further rectification column 8 is provided with a condenser 12 at its head and the stripping column 10 with a reboiler 14 at the bottom thereof.

In operation, a first stream of purified air at the operating pressure at the bottom of the higher pressure rectification column (typically in the range of 4 to 6 bar) and at a temperature at or near its dew point enters the bottom of the higher pressure column 4 in vapour state through a first inlet region 16. A second stream of purified air, in liquid state, is introduced into an intermediate region of the higher pressure column 4 through a second inlet 18. Rising vapour is separated in the column 4 by mass transfer with descending liquid. A vaporous nitrogen fraction is obtained at the top of the higher pressure column 4 and an oxygen-enriched liquid fraction at the bottom thereof.

Nitrogen vapour flows from the top of a higher pressure column 4 and is condensed in the condenser-reboiler 7 by heat exchange with boiling liquid oxygen. Part of the resulting condensed nitrogen is returned to the top of the higher pressure column 4 and serves as reflux therein. The remainder of the liquid nitrogen condensate is sub-cooled by passage through a heat exchanger 20, is passed through a throttling valve 22, and is introduced into the top of the lower pressure rectification column 6, serving as reflux therein. A stream of the oxygen-enriched liquid fraction is withdrawn from the bottom of the higher pressure column 4 to an outlet 24, is sub-cooled in the heat exchanger 20 and is passed through a throttling valve 26 into the condenser 12 which comprises a heat exchanger block 28 and a vessel 30. A part of the oxygen-enriched liquid is vaporised by heat exchange in the block 28 with condensing argon vapour. A stream of the resulting vapour flows out of the vessel 30 from an outlet 32 and is introduced through an inlet 34 into the lower pressure rectification column 6 for separation therein. Unboiled liquid from the condenser 12 passes out of the vessel 30 through an outlet 36 and flows into the lower pressure rectification column 6 through an inlet 38 which is typically but not necessarily at the same level as the inlet 34. If desired, a further stream of air may be introduced into the lower pressure column 6 at approximately its dew point from a turbo-expander (not shown). Alternatively, or additionally, a part of the air flow to the higher pressure column 4 through the first inlet 16 may be provided by a turbo-expander (not shown).

The air is separated in the lower pressure column 6 into a first liquid oxygen fraction that collects at the bottom and a nitrogen fraction at the top of the lower pressure column 6. A part of the first liquid fraction is reboiled in the condenser-reboiler 7 by indirect heat exchange with the condensing nitrogen. An ascending vapour fraction through the lower pressure column 6 is thus formed. Mass exchange takes place between the ascending vapour and descending liquid.

The first oxygen liquid fraction typically contains less than 1% by volume of impurities. The lower pressure column 6 therefore contains an argon-oxygen separation section 40 in order to enable separation of argon from oxygen to take place. A stream of argon-enriched oxygen vapour typically containing from 5 to 1 5% by volume of argon is withdrawn from an intermediate location of the lower pressure column 6 through an outlet 42 and is introduced into a bottom region of the further rectification column 8 for separation therein.

The air streams entering the higher pressure column 4 contain krypton and xenon in normal concentrations, that is to say, the air contains about 1.1 volumes per million of krypton and about 0.08 volumes per million of xenon. Krypton and xenon are far less volatile than oxygen, nitrogen or argon. Oxygen itself is of a lower volatility than either argon or nitrogen. Thus, the krypton and xenon entering the higher pressure column 4 tend to concentrate in the oxygen-enriched liquid fraction obtained at the bottom of that column and therefore pass to the lower pressure column 6. In the column 6, the concentration of krypton and xenon in the descending liquid a few stages (theoretical trays) above the condenser-reboiler 7 is essentially the same as that in the feed air. The concentration in the vapour phase is lower than that in the liquid by a factor of one K value, i.e. 10 for krypton and 80 for xenon. Therefore, the argon-enriched oxygen vapour stream which is taken for separation in the further rectification column 8, the outlet 42 being typically at a level many theoretical trays above the lowermost one in the column 6 contains a small amount of krypton and xenon relative to the descending liquid. Accordingly, by ultimately taking the oxygen product from this stream, it is possible to reduce losses of these rare gases.

The stream of oxygen-enriched oxygen vapour is separated in the further rectification column into an argon vapour fraction at the top and an argon-enriched liquid fraction at the bottom thereof. The argon fraction may typically contain up to 5% by volume of oxygen impurity depending on the number of theoretical trays provided by the liquid-vapour contact devices in the further rectification column 8. If essentially oxygen-free argon is required more than 180 theoretical trays are typically provided. With such a number of theoretical trays, it is often desirable to divide the column 8 into two separate parts as shown, for example, in GB-A-2 311 123. A flow of the argon vapour is condensed in the condenser 12. A part of the resulting liquid argon is taken as product through an outlet 46 and the remainder is returned to the top of the further rectification column 8 as reflux.

A flow of the liquid argon-enriched oxygen fraction passes through an outlet 48 at the bottom of the column 8 and flows into the top of the stripping column 10. Argon is stripped therefrom in the stripping column 10 with the result that a second relatively pure liquid oxygen fraction typically containing less than 1% by volume impurities is obtained at the bottom of the stripping column 10. The stripping gas is created by recoiling part of this fraction in that the reboiler 14. The reboiler 14 is cooled by diverting to it a part of the nitrogen vapour flowing from the top of the higher pressure column 4 to the condenser-reboiler 7. The nitrogen vapour is condensed in the reboiler 14 and the resulting condensate is typically reunited with the stream of nitrogen condensate passing from the higher pressure column 4 to the lower pressure column 6, the reunion being effected upstream of the heat exchanger 20. The vapour fraction which is obtained at the top of the stripping column 10 is reunited with the vapour flowing from the lower pressure rectification column 6 to the further rectification column 8. A liquid oxygen product is formed by taking a part of the second liquid fraction from the bottom of the stripping column 10 and pressurising it in a pump 50. The resulting pressurised liquid oxygen may be vaporised in heat exchange relation with the air that is condensed upstream of being supplied to the second inlet 18 into the higher pressure column 4. In general, a mass balance is maintained between the liquid products withdrawn from the arrangement of columns shown in FIG. 1 and the liquid air entering the higher pressure column 4 through the inlet 18.

Because the argon-enriched liquid oxygen fed to the top of the stripping column 10 is depleted of krypton and xenon, losses of krypton and xenon in the liquid oxygen product which is withdrawn from the second liquid oxygen fraction. In conventional arrangements the argon-enriched liquid oxygen fraction obtained at the bottom of the further rectification column is returned to the argon-oxygen separation section in the lower pressure rectification column with the result that the provision of the further rectification column has no effect on the concentration of krypton and xenon in the first liquid oxygen fraction. However, in the arrangement shown in FIG. 1, there is no such return of liquid to the section 40 in the lower pressure column 6. Accordingly, a greater concentration of krypton and xenon in the first liquid oxygen fraction may be obtained. Further, as shown in FIG. 1, the only oxygen product withdrawn from the lower pressure rectification column 6 is a stream of the first liquid oxygen fraction containing krypton and xenon. This stream is withdrawn through an outlet 52 and may be passed to a storage vessel (not shown) and taken, as desired, from the storage vessel for further purification by conventional means so as to produce relatively pure krypton and xenon products.

Figure 2:
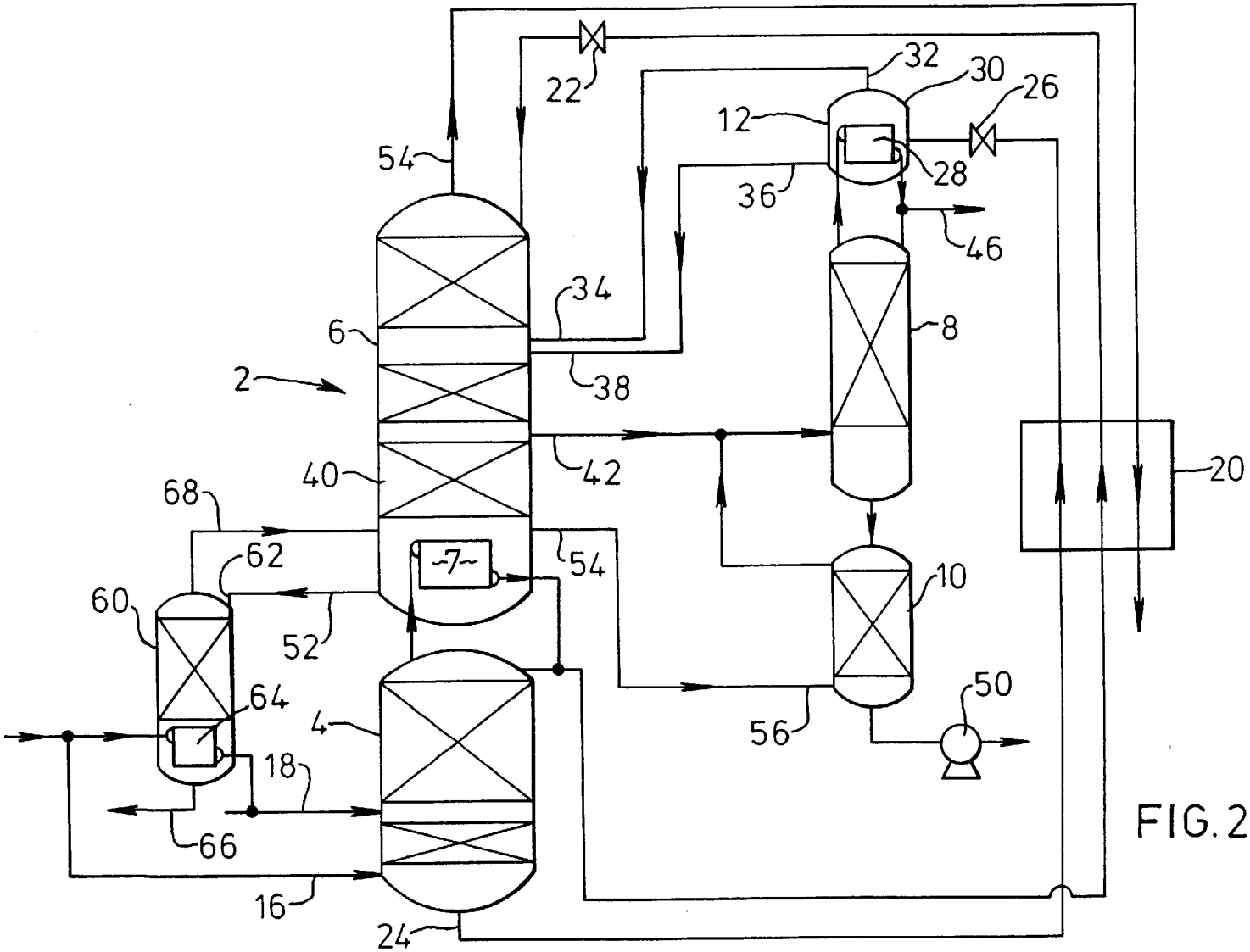
FIG. 2 is a schematic diagram of an alternative arrangement of columns to that shown in FIG. 1.

Referring now to FIG. 2 of the drawings, the arrangement of columns shown therein has many similarities to that shown in FIG. 1. However, the stripping gas for the stripping column 10 is taken from the lower pressure column 6 through an outlet 54 therefrom. The stripping gas is introduced into the bottom of the stripping column 10 through an inlet 56. The stripping gas may be taken from a level below that of all liquid-vapour contact devices in the lower pressure column 6 or may be taken from a level a few theoretical trays above the bottom thereof depending on the purity required for the oxygen product that is withdrawn from the bottom of the stripping column 10. If, as shown in FIG. 2, the point of withdrawal of the stripping gas is below all the liquid-vapour contact devices in the lower pressure column 6, the stripping gas contains some krypton and xenon. Therefore, there is loss of krypton and xenon in the liquid oxygen product. As a result, the first liquid oxygen fraction collected at the bottom of the lower pressure column 6 tends to be less concentrated in krypton and xenon than the corresponding fraction obtained in operation of the arrangement of columns shown in FIG. 1. Referring again to FIG. 2, it is therefore desirable to subject the stream of the first liquid fraction withdrawn from the lower pressure column 6 through the outlet 52 to further rectification. This is done in an auxiliary rectification column 60. The stream of liquid oxygen concentrated in krypton and xenon withdrawn from the lower pressure column 6 enters the top of the auxiliary rectification column 60 through an inlet 62. The auxiliary rectification column 60 is provided with a reboiler 64 at its bottom. Liquid collecting at the bottom is partially reboiled in the reboiler 64 so as to create an upward flow of vapour through the column 60 which undergoes mass transfer with descending liquid. As a result of the mass transfer, the descending liquid becomes further concentrated in krypton and xenon. Typically, the bottom liquid fraction obtained in the auxiliary rectification column contains from 0.2 to 1.0% by volume of krypton and xenon. A stream of this liquid fraction is withdrawn from the bottom of the column 60 through an outlet 66 and may be collected as a product for further purification by conventional means. A stream of vapour is returned via a conduit 68 from the top of the auxiliary rectification column 60 to a region of the lower pressure column 6 just below the lowermost liquid-vapour contact device therein. The reboiler 64 is heated by means of a stream of vaporous air which is typically taken from that being fed to the first inlet 16 to the higher pressure column 4. The air passing through the reboiler 64 is condensed. The resulting condensate is mixed with the stream of liquid air entering the higher pressure column through the second inlet 18.

Figure 3:
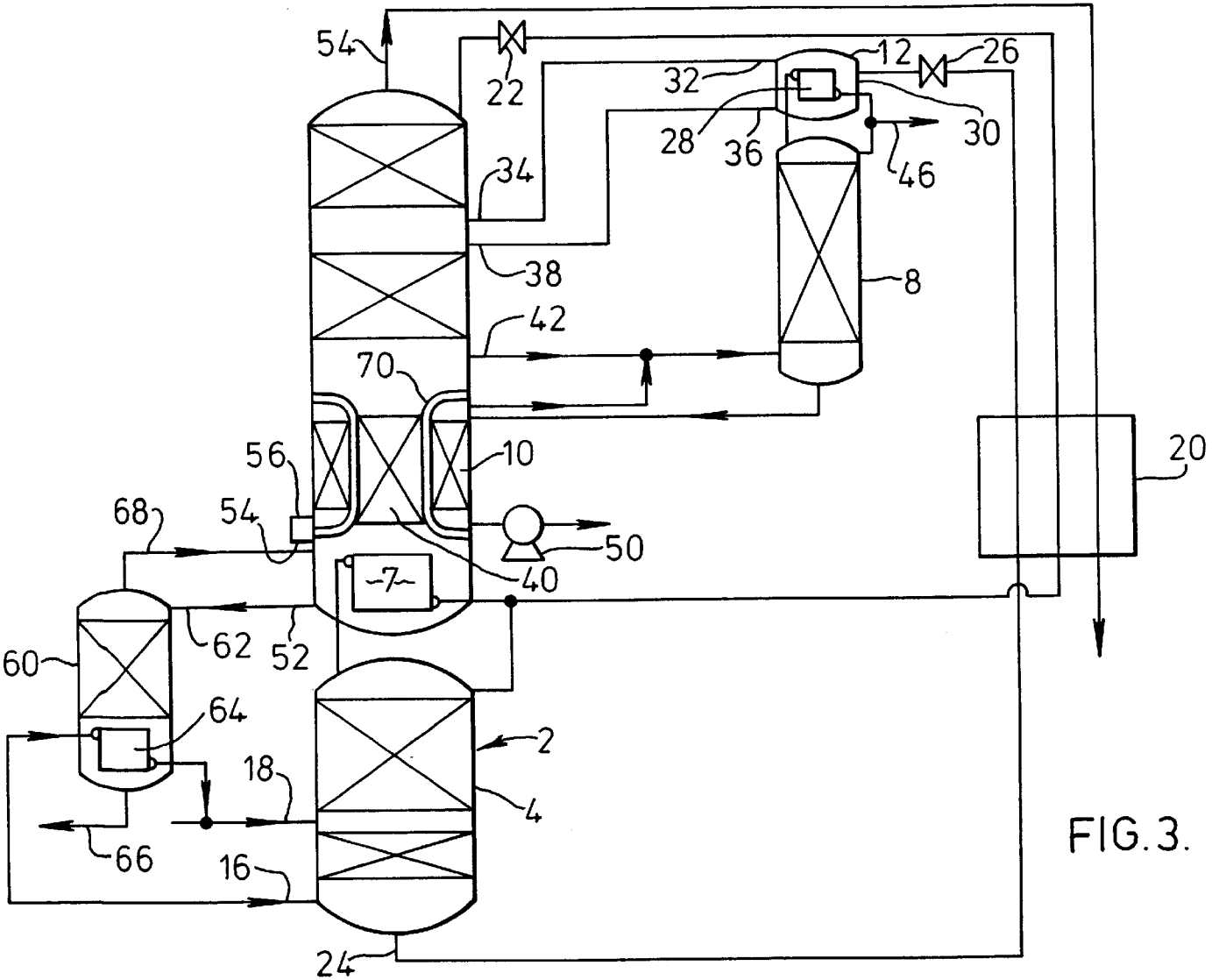
FIG. 3 is a schematic flow diagram of another alternative arrangement of columns to that shown in FIG. 1.

The arrangement of columns shown in FIG. 3 and its operation is essentially the same as that shown in FIG. 2 except the stripping column 10 rather than being provided as a discrete unit is housed within the lower pressure column 6. Thus, the lower pressure rectification column 6 is provided with dividing walls 70 that define with the outer wall of the lower pressure column 6 the stripping column 10.

Figure 4:
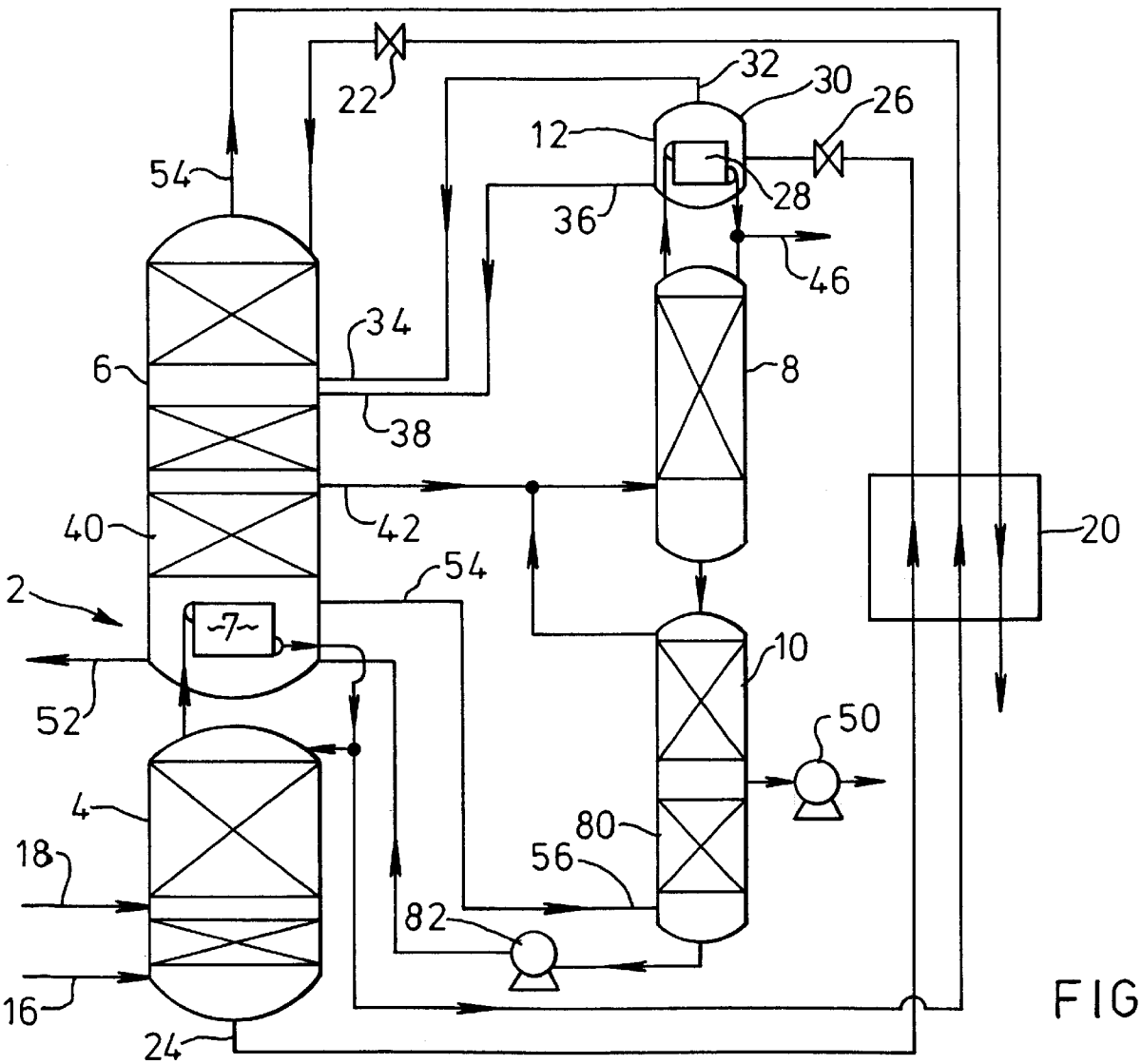
FIG. 4 is a schematic flow diagram of yet another alternative arrangement of columns to that shown in FIG. 1.

Referring to FIG. 4 of the drawings, there is shown another arrangement of columns in which the stripping gas for the stripping column 10 is provided from the lower pressure column 6. However, in order to recover most or all of the krypton and xenon which is introduced into the stripping column 10 with the stripping gas, the stripping column 10 is provided with a wash section 80 below the level of the outlet to the pump 50 for the liquid oxygen product. A sufficient liquid flow through the wash section 80 is maintained so as to effect the absorption from the vapour phase of krypton and xenon. The inlet 56 to the stripping column 10 is thus located at a bottom region of the wash section 80. The liquid collected at the bottom of the wash section 80 is returned by a pump 82 to the first liquid fraction in the bottom of the lower pressure column 6.

As a result of the incorporation of the wash section 80 in the stripping column 10, the liquid oxygen product withdrawn by the pump 50 is further reduced in krypton and xenon content. As a result, it is possible to obtain a higher recovery of krypton and xenon in the first liquid oxygen fraction collected in the lower pressure column 6 than in the corresponding fraction obtained in operation of the arrangements of columns shown in FIGS. 2 and 3. Therefore, as shown FIG. 4, the auxiliary rectification column employed in the arrangements shown in FIGS. 2 and 3 is omitted. If desired, however, this column may be included so as to maximise the krypton and xenon concentrations in the concentrate derived from the first liquid oxygen fraction. If desired, the wash section 80 may be incorporated in a separate column (not shown) from the stripping column 10. If desired, the separate column and stripping column 10 may be located side by side.

Guard adsorbers (not shown) are preferably employed in the plant illustrated in the accompanying drawings in a conventional manner so as to prevent potentially explosive mixtures of oxygen and hydrocarbons from being created.

I claim:

1. A method of separating air comprising:

subjecting air to a main rectification which includes an argon-oxygen separation and in which a first liquid oxygen fraction concentrated in krypton and xenon is formed;

taking a vaporous argon-oxygen stream depleted of krypton and xenon from the main rectification;

subjecting the vaporous argon-oxygen stream to further rectification and thereby obtaining a second liquid oxygen fraction containing argon impurity;

taking a stream of the first liquid oxygen fraction as a krypton-xenon concentrate; and purifying the second liquid oxygen fraction separately from the main rectification and thereby obtaining a purified oxygen product.

2. The method according to claim 1, wherein the main rectification is conducted in a double rectification column comprising a higher pressure column, a lower pressure column, and a condenser-reboiler placing the higher pressure column in heat exchange relationship with the lower pressure column.

3. The method according to claim 1, in which the purification of the second liquid oxygen fraction comprises countercurrent contact between a stripping gas and a flow of the second liquid oxygen fraction.

4. The method according to claim 3, wherein following the countercurrent contact the stripping gas is introduced into the further rectification.

5. The method according to claim 3, in which the stripping gas is formed by reboiling the purified oxygen product.

6. The method according to claim 3, in which the stripping gas is taken from the vapour formed by reboiling a part of the first liquid oxygen fraction.

7. The method according to claim 1, wherein the main rectification is conducted in a double rectification column comprising a higher pressure column, a lower pressure column, and a condenser-reboiler placing the higher pressure column in heat exchange relationship with the lower pressure column; the stripping gas is taken from the vapour formed by reboiling a part of the first liquid oxygen fraction, and the stripping gas contains krypton and xenon, and is subjected to a preliminary washing with a first part of the stripped liquid oxygen fraction, another part or the remainder of the stripped oxygen fraction being taken as the purified oxygen product.

8. The method according to claim 7, in which liquid enriched krypton and xenon are returned from the washing to the main rectification.

9. The method according to claim 1, in which the product stream of the first liquid oxygen fraction is subjected to further concentration in krypton and xenon in an auxiliary rectification column.

10. The method according to claim 9, in which a part of the resulting further concentrated liquid oxygen fraction is reboiled and another part is sent to storage before being sent to further treatment to yield separate krypton and xenon product.

11. The method according to claim 9, in which the vapour fraction at the head of the auxiliary rectification column is returned to the main rectification.

12. The method according to claim 1, in which the purified oxygen product is taken in liquid state, is raised in pressure and is vaporised in heat exchange relationship with air to be separated in the main rectification.

13. An apparatus for the separation of air comprising:

a main rectification column for performing a main rectification of air so as to obtain a first liquid oxygen fraction concentrated in krypton and xenon;

a main rectification column having an argon-oxygen separation section;

a first outlet from the main rectification column for a vaporous argon-oxygen stream depleted of krypton and xenon;

a further rectification column for obtaining from the vaporous argon-oxygen stream a second liquid oxygen fraction containing argon impurity;

at least one further liquid-vapour contact column or column section for purifying the second liquid oxygen separately from the main rectification and for thereby obtaining a purified oxygen product; and a second outlet from the main rectification column for a stream of the first liquid oxygen fraction as a krypton-xenon concentrate.

14. The apparatus according to claim 13, in which the main rectification column is a double rectification column comprising a higher pressure column, a lower pressure column, and a condenser-reboiler placing the higher pressure column in heat exchange relationship with the lower pressure column.

15. The apparatus according to claim 13, in which the additional liquid-vapour contact column is a stripping column separate from the further rectification column or columns.

16. The apparatus according to claim 13, in which the main rectification column is a double rectification column comprising a higher pressure column, a lower pressure column, and a condenser-reboiler placing the higher pressure column in heat exchange relationship with the lower pressure column; in which the additional liquid-vapour contact column is a stripping column separate from the further rectification column or columns; and in which the stripping column has an inlet at its bottom in communication with an outlet for oxygen vapour from the main rectification column.

17. The apparatus according to claim 16, in which the stripping column has a wash section or wash column associated therewith for removing krypton and xenon from the said oxygen vapour.

* * * * *